United States Patent [19]

Conkey

[11] Patent Number: 4,827,651

[45] Date of Patent: May 9, 1989

[54] AID FOR LOADING BULLETS INTO A MAGAZINE

[76] Inventor: Carroll E. Conkey, 24011 S. Skylane Dr., Canby, Oreg. 97013

[21] Appl. No.: 57,172

[22] Filed: Jun. 2, 1987

[51] Int. Cl.[4] ..... F42B 39/06

[52] U.S. Cl. ..... 42/87

[58] Field of Search ..... 42/87, 88, 90

[56] References Cited

U.S. PATENT DOCUMENTS

| | | | |
|---|---|---|---|
| 2,466,017 | 4/1949 | Farber | 42/90 |
| 2,514,277 | 7/1950 | Donnallan | 42/909 |
| 2,862,324 | 12/1958 | Ball | 42/90 |
| 3,509,655 | 5/1970 | Wilhelm | 42/87 |
| 4,464,855 | 8/1984 | Musgrave | 42/87 |
| 4,488,371 | 12/1984 | Boyles | 42/90 |
| 4,570,371 | 2/1986 | Mears | 42/90 |
| 4,689,909 | 9/1987 | Howard | 42/87 |

*Primary Examiner*—Charles T. Jordan

*Attorney, Agent, or Firm*—James D. Givnan, Jr.

[57] ABSTRACT

A box shaped slide for positioning about a bullet magazine with the slide having at least one appendage for finger actuation. An arm depends into the magazine upper end for downward displacement of an uppermost bullet to enable effortless insertion of a following bullet. A modified bullet loading aid utilizes finger pressure to depress a button on the magazine which in turn compresses a magazine follower and slide to permit bullet insertion.

3 Claims, 1 Drawing Sheet

AID FOR LOADING BULLETS INTO A MAGAZINE

BACKGROUND OF THE INVENTION

The present invention pertains generally to devices facilitating the insertion of bullets into magazines of firearms.

The loading of bullets into a magazine entails the progressive compression of the magazine spring. Initial loading may be accomplished without substantial manual effort while the latter stages of loading, by reason of increased spring resistance, presents a problem. Typically the bullet being loaded into the magazine is held by its nose and the base of the bullet used to depress the previously loaded bullet. Accordingly both substantial downward and inward pressure must be exerted on the bullet being loaded as it is slid into the clip or magazine. In addition to the manual dexterity required, a degree of finger strength is necessary. Still further, the unaided loading of magazines is a tedious, time consuming task which consumes costly time when accomplished at a busy firing range.

In the prior art are devices to assist loading of magazines, one such device being disclosed in U.S. Pat. No. 4,570,371 wherein a base is clamped to the upper end of the magazine whereafter a lever of the device rocks into engagement with and is used to depress the previously loaded bullet. Another device disclosed in U.S. Pat. No. 4,464,855 has a bullet engaging plate and an elongate base movable along the forward edge of the magazine. A spring biased pin engages an opening in the magazine front wall to hold the device against the action of the magazine spring. Such a device requires considerable effort to use with repeated engagement and disengagement from the magazine. Still other clip loading devices serve to temporarily attach to the magazine with a hook component of the device holding a slidable magazine button fully depressed. As the bullets are loaded, they fall freely into the magazine with the risk of coming to rest askew in the magazine. Examples of these devices are found in U.S. Pat. Nos. 4,464,855; 4,488,371 and 2,514,277.

SUMMARY OF THE PRESENT INVENTION

The present invention is embodied in a loading aid which slidably encompasses the magazine and receives manually imparted forces to compress the magazine spring.

The present aid is adapted for sliding engagement about the magazine. An appendage on the aid permits finger pressure to momentarily compress the magazine spring. In another form of the invention, the aid progressively compresses the spring to assure effortless entry of the bullet into the magazine and prevents misorientation of the bullet during entry into the clip.

A slide portion of the aid includes an arm having a depending end segment which momentarily enters the loading end of the magazine to depress the last loaded bullet to permit the next bullet to be partially inserted below the upper parallel edges of the clip. The slide is then lifted somewhat by the user's finger to permit the round being loaded to be slid rearwardly home beneath the arm into a loaded position. The walls of the slide provide adequate bearing surfaces to prevent tipping or binding of the slide on the clip even during the latter stages of loading when the magazine spring approches maximum compression.

In a modified form of the aid intended for small caliber magazines having a side located button for spring compression, the underside of the slide engages the button to progressively collapse the spring using finger pressure.

Important objectives include the provision of a magazine loading aid for sliding engagement with the walls of the magazine and having an arm depending into the magazine for intermittent downward displacement of the uppermost bullet enabling convenient insertion of a following bullet; the provision of a bullet loading aid which has a downwardly extending arm which bears upon the rearward or base of the bullet to permit a new round to be effortlessly inserted intermediate the last loaded round and the top end of the magazine whereafter rearward seating of the bullet is accomplished without further reliance on the bullet depressing arm; the provision of a magazine loading aid which is of low cost construction and of a size easily carried on the person.

DETAILED DESCRIPTION OF THE PREFERRED EMBODIMENTS

Figure 1:
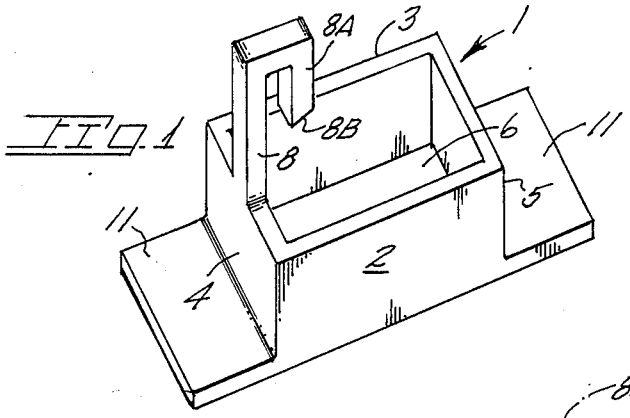
FIG. 1 is a perspective view of the present magazine loading aid.
Figure 2:
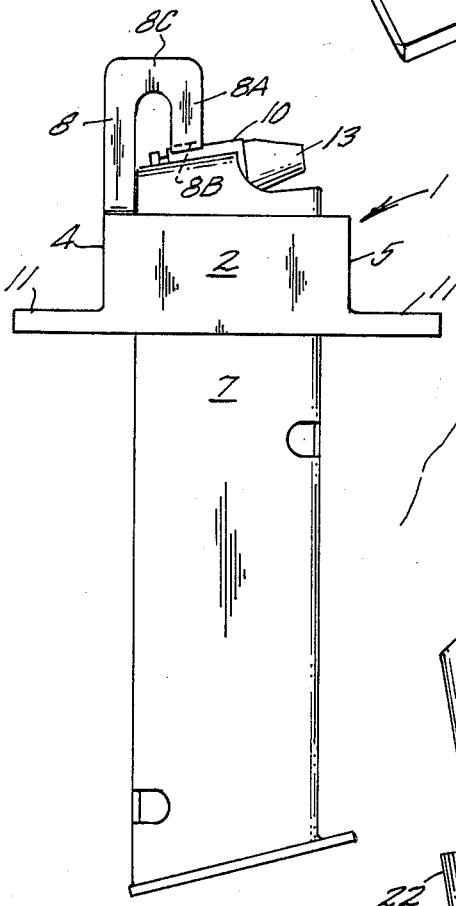
FIG. 2 is a front elevational view of a magazine with the present aid operatively deposed thereon.

With continuing attention to the drawings wherein applied reference numerals indicate parts similarly hereinafter identified, reference numeral 1 indicates generally the present aid.

Upright walls at 2, 3, 4 and 5 define an open area 6 within which is slidably received the upper end of a magazine 7. The magazine shown is intended to be typical of a magazine used in automatic or semi-automatic firearms. The internal surface of the slide walls 2 through 5 are disposed so as to slidably receive the upper end of magazine 7 without binding.

Figure 3:
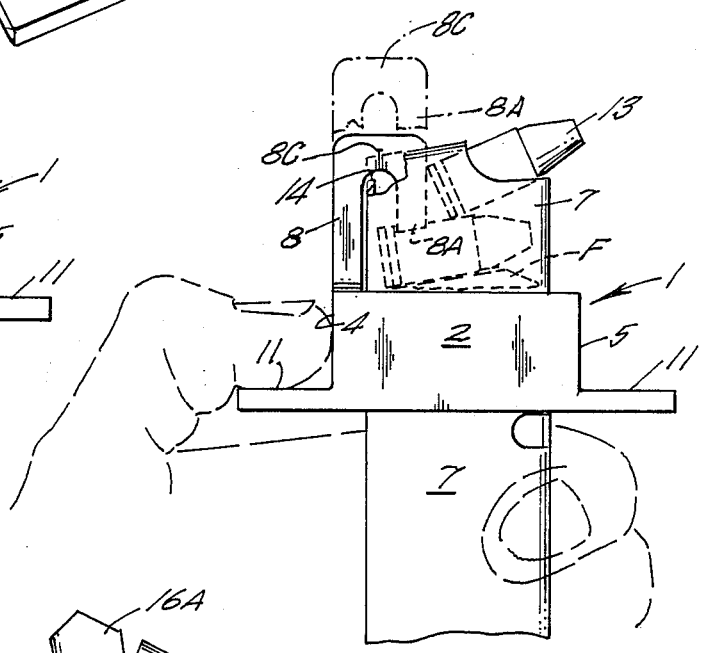
FIG. 3 is a fragmentary front elevational view of the magazine with the aid depressed from its position shown in FIG. 2.

Spring compression means are shown as an arm 8 having a depending portion 8A terminationg in a bottom end wall 8B. Preferably end wall 8B is formed on a radius to provide a concave surface engageable with the bullet casing at 10. Arm segment 8A permits entry of said segment into the upper end of the magazine as shown in FIG. 3 to depress the uppermost bullet in the magazine and any bullets therebelow against the action of the magazine internal spring which acts on a follower F.

Application of manual force to the aid is facilitated by appendages 11 which are of a size to accommodate the users thumb and/or the tip of any other fingers.

Downward displacement of the aid and the uppermost bullet within the clip greatly facilitates initial entry of the bullet being loaded. With attention to FIG. 3, loading of the bullet is completed by lifting of the aid slightly with the thumb or other finger applied to the underside of the aid to lift arm segment 8A. Completion of bullet loading is by fingertip pressure on the bullet nose 13. Some magazines are recessed as at 14 and permit entry of the arm upper extremity 8C.

Figure 4:
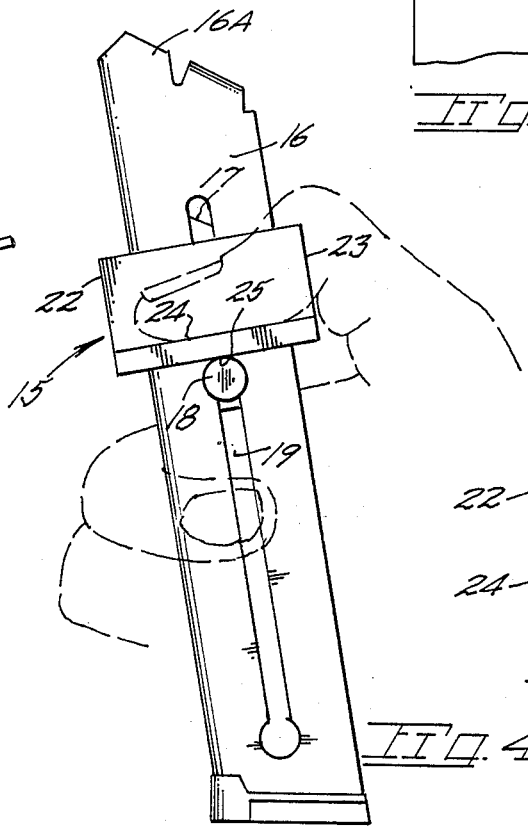
FIG. 4 is a front elevational view of a magazine for small caliber bullets with a modified aid disposed thereon.
Figure 5:
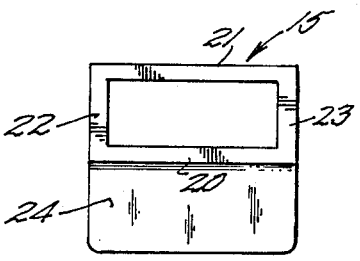
FIG. 5 is a plan view of the aid shown in FIG. 4 removed from the magazine.

With reference to FIG. 4, a modified loading aid is shown at 15 particularly suited for use in loading a magazine 16 having an external button 18 normally moved by finger exerted pressure to collapse the magazine spring. Such magazines are most commonly found in 0.22 caliber firearms. The magazine 16 has an upper bullet receiving end 16A and an internal spring follower 17 which is biased upwardly by a magazine spring (not shown). The follower 17 is adapted to be depressed downwardly upon the application of finger exerted force to button 18 carried by follower 17 and which protrudes through a lengthwise slot 19 in the magazine. The foregoing is intened to be typical of a small caliber firearm magazine.

The modified aid includes walls 20, 21, 22 and 23 having internal surfaces which slidably engage the exterior wall surfaces of magazine 16. A flange 24 integral with one of said walls is of a size and location to conveniently receive fingertip pressure for the gradual collapsing of the magazine spring during the gradual lowering of follower 17. Gradually lowering the follower 17 is desirable for the reason that the bullets are prevented from falling within the magazine and incurring the risk of becoming mis-orientated within the magazine as is likely if follower 17 were fully displaced to the bottom of the magazine. Spring compression means are embodied in a lower surface 25 of aid 15 which comes into bearing contact with button 18.

While I have shown but a few embodiments of the invention, it will be apparent to those skilled in the art that the invention may be embodied still otherwise without departing from the spirit and scope of the invention.

Having thus described the invention, what is desired to be secured in a Letters Patent is:

I claim:

1. A bullet loading aid for the magazine of a weapon with the magazine having a bullet follower biased by an internal spring of the magazine, said aid comprising in combination, a slide of box configuration with multiple upright walls jointly defining an open area enabling placement of the slide on the magazine, spring compression means carried by said slide and comprising an arm integral with one of said walls and projecting upwardly therefrom and having an upper extremity and a depending end segment depending from said upper extremity and normally offset upwardly from said slide for lengthwise insertion into the bullet receiving end of the magazine to depress the uppermost bullet therein during a magazine loading operation, and at least one appendage integral with said slide to receive fingertip pressure for displacement of the bullet follower and any bullets in place thereon downwardly against the action of the magazine spring to facilitate loading of another bullet into the magazine.

2. The bullet loading aid claimed in claim 1 wherein said depending end segment of the arm terminates in a concave surface for engagement with the casing of the uppermost bullet in the magazine.

3. The bullet loading aid claimed in claim 1 wherein said slide is of elongate shape with certain of said upright walls being of lesser length than remaining upright walls, said one appendage carried by one of said walls of lesser length.

* * * * *